US005551507A

United States Patent [19]

Vogel

[11] Patent Number: 5,551,507

[45] Date of Patent: Sep. 3, 1996

[54] FINNED HEAT EXCHANGER SUPPORT SYSTEM

[75] Inventor: Kenneth E. Vogel, Yuma, Ariz.

[73] Assignee: Russell a Division of Ardco, Inc., Brea, Calif.

[21] Appl. No.: 405,593

[22] Filed: Mar. 17, 1995

[51] Int. Cl.[6] ..... F28F 7/00

[52] U.S. Cl. ..... 165/82; 165/149; 165/151; 165/DIG. 52; 165/DIG. 480; 29/890.043

[58] Field of Search ..... 165/81, 82, 149–151; 29/890.043, 890.047

[56] References Cited

U.S. PATENT DOCUMENTS

| | | | |
|---|---|---|---|
| 1,759,167 | 5/1930 | Modine | 165/149 |
| 2,072,975 | 3/1937 | Winsborough et al. | 165/82 |
| 2,267,314 | 12/1941 | Stikeleather | 165/149 |
| 2,347,957 | 5/1944 | McCullough | 165/149 X |
| 4,186,474 | 2/1980 | Hine | 29/890.047 |
| 5,020,587 | 6/1991 | Mongia et al. | 165/82 |
| 5,404,942 | 4/1995 | Patel | 165/151 X |

FOREIGN PATENT DOCUMENTS

| | | | |
|---|---|---|---|
| 0209107 | 12/1988 | European Pat. Off. . | |
| 259395 | 10/1988 | Japan | 165/150 |
| 208498 | 8/1990 | Japan | 165/906 |

*Primary Examiner*—Leonard R. Leo
*Attorney, Agent, or Firm*—Knobbe, Martens, Olson & Bear

[57] ABSTRACT

Leaks in tube bundles for a heat exchanger are eliminated or minimized by tube interrelated techniques. A floating tube bundle is constructed with separate support elements also secured to the heat dissipating fins and extending through and supported by the support plates. Thin-walled copper tubing similar to that used for the fluid-carrying tubes is used as support tubes, and steel rods are inserted into these support tubes to provide the necessary strength. To minimize leakage in the area where the tube bundle is joined to a header, connector tubes are provided that have one end joined to the header and the other end extending into one of the tubes of the tube bundle sufficiently far that the end of the connector tube passes through the support plate and at least one fin.

10 Claims, 3 Drawing Sheets

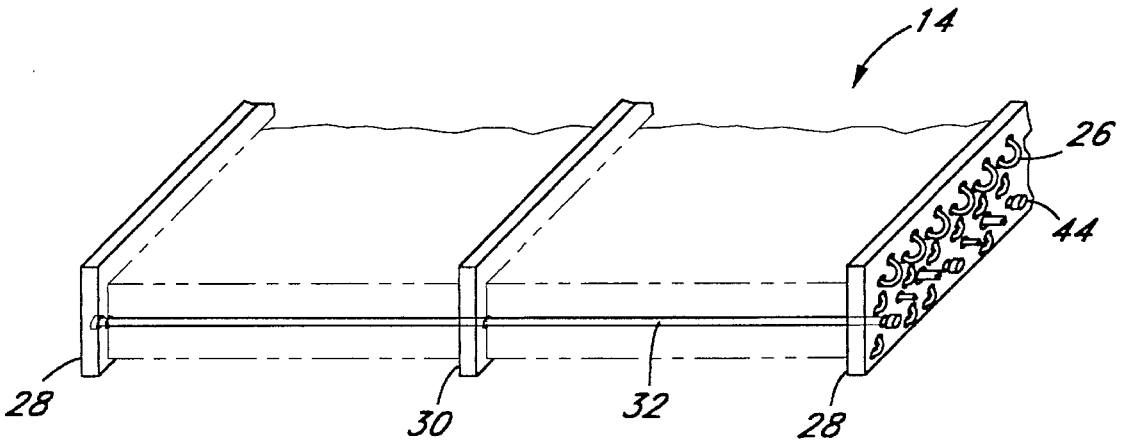
Fig. 2
Fig. 3
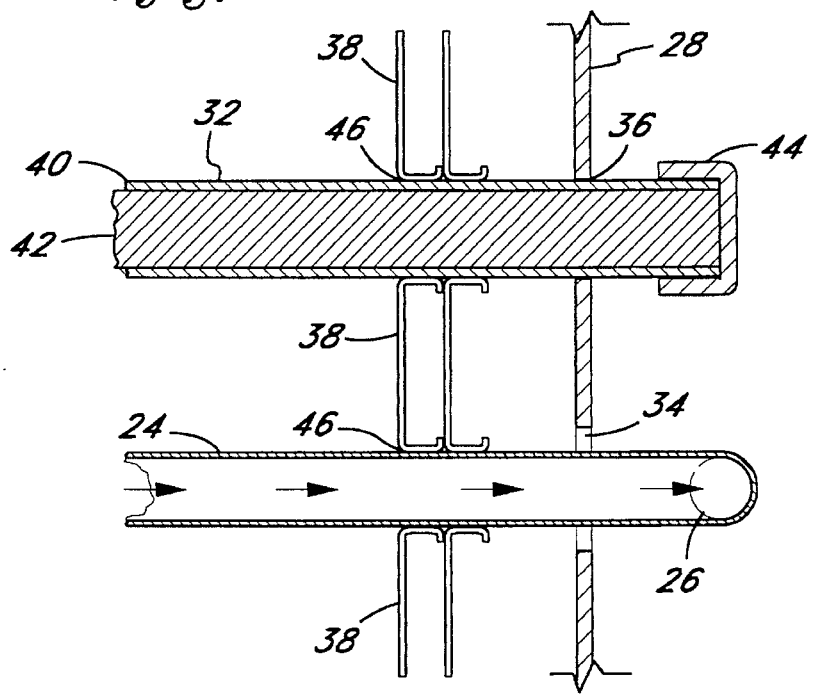

FINNED HEAT EXCHANGER SUPPORT SYSTEM

FIELD OF THE INVENTION

This invention relates to finned heat exchangers and particularly to air-cooled refrigeration condensers.

BACKGROUND OF THE INVENTION

One common type of air-cooled heat exchanger includes a tube bundle having a large number of thin-walled, copper parallel tubes connected in pairs at their ends by return bends to form a fluid circuit. Thin metal, parallel plates, referred to as fins, are secured generally transverse to the tubes to transfer heat from the tubes. These tube bundles in turn must be supported by additional structure. One common practice is to provide a rigid connection between the tubes of the tube bundle and two or more spaced support plates or other support means at the end of the tubes and sometimes in center portions of the tubes.

When the heat exchanger is a refrigeration condenser, air is passed over the tubes of the condenser in order to lower the temperature of, and hence condense, vapor refrigerant flowing through the tubes from a refrigerant compressor. During this cooling process, the tube bundle is subject to vibrations caused by pulsations of the fluid flowing within the condenser. Also, motors and fans moving the cooling air produce vibrations. In addition, the tubes forming the tube bundle are subject to expansion and contraction due to changes in temperature during the heat exchange process. As a result of the vibrations and the temperature changes there is great stress placed upon the tubes at locations where they are rigidly attached. This stress can result in leaks at the points of contact. Locating and repairing those leaks can be a difficult task.

One solution to this problem is to use thicker wall copper tube. This of course adds weight and expense. Another possible solution is to use softer tube support material to absorb movement due to vibration and expansion and contraction. This approach also has its shortcomings. Yet another approach is to allow the tubes to move within support plates while still having the plates provide the direct support for the tubes. This of course produces wear on the tubes, which again results in leaks.

While there are advantages to have each tube share the support function because of the total contact area involved, yet another approach that has been developed utilizes additional support tubes or rods that are attached to support plates, while the fluid-carrying tubes extend through oversized holes in the support plates so that there is little or no contact between the fluid-carrying tubes and the support plates. This is sometimes referred to as a floating tube bundle in the sense that the fluid-carrying tubes can move freely within the support plates. Examples of this system are disclosed in U.S. Pat. No. 5,020,587 and in European patent 0209107. In one instance a relatively large number of copper tubes are employed for the support function. In another instance smaller numbers of tubes or rods are employed using materials stronger than copper. Because of the shortcomings with both approaches, a need exists for an improved support arrangement.

Another source of leaks in heat exchange or tube bundles occurs in the area of the discharge header. Each tubular circuit within a tube bundle requires an input and output connection to a header which extends generally perpendicular to the straight sections of the tube bundle. Bundles with a large number of tubes will have a number of fluid circuits and hence a number of corresponding connections to the header. Leaks can occur if the tube support plates make contact with the tubes that are attached to the header. Thermal expansion or contraction of the tubes causes wear. Most manufacturers have solved this problem by having clearance holes in the tube plate at these locations. Leaks can also be caused by the thermal expansion or contraction of the header itself. Because the expansion coefficient is linear, a long header expands more than a short header. The outermost tubes connected to the header will therefore bend the most. Headers over four feet long can cause fatiguing of the outermost tubes. Most manufacturers now limit the length of the header. In actual application, field manifolding should be configured so that some of the expansion or contraction can be absorbed at the manifolds.

Leaks can also result from improper support of the field piping connected to the headers. Further, the condenser fans and the compressor produce additional vibrations in the piping. The resulting stress is concentrated at the fluid-carrying tubes that tie into the header, primarily at the point where these tubes pass into the bundle. Small circuits with only one, two or three tubes into the header are particularly susceptible to leaks from this cause. Typically, the connection between the header and a tube in the tube bundle is made by a short connector tube which has one end connected to the header and the other end connected to one of the tube ends protruding through a support plate. Leaks typically occur at the ends of these connector tubes.

In view of the foregoing, a need exists for an improved arrangement for supporting a tube bundle in a manner to minimize leaks in the system.

SUMMARY OF THE INVENTION

In accordance with the present invention, the leaks in the tube bundles are eliminated or minimized by tube interrelated techniques. A plurality of fluid-carrying tubes are joined to the heat dissipating fins in the usual manner, and these tubes extend through oversized holes in spaced, parallel support plates. Separate support elements also secured to the heat dissipating fins extend through and are supported by the support plates. Thin-walled copper tubing similar to that used for the fluid-carrying tubes is used as support tubes. This allows the support tubes to be expanded into the support plates in the same fashion that copper tubing is conventionally expanded into tight engagement with the cooling fins. The thin-walled support tubing by itself, however, does not provide sufficient support unless a sufficient number of them are utilized. In accordance with one aspect of the invention, steel rods are inserted into these support tubes to provide the necessary strength. Thus that approach has the advantage of common manufacturing techniques, but yet has the strength of steel rods. With such an arrangement only a minimum number of such reinforced support elements are required to adequately support a tube bundle.

To minimize leakage in the area where the tube bundle is joined to a header, connector tubes are provided that have one end joined to the header and the other end extending into one of the tubes of the tube bundle sufficiently far that the end of the connector tube passes through the area of the support plate and into the area of at least one of the heat dissipating fins on the exterior of the fluid-carrying tube. By extending the connecting tube to this extent, the header load which must be carried by the tube bundle is distributed over to a larger area and to a more firmly supported area. In a preferred approach, the end of the tube in the tube bundle to which the connector tube is attached is flared on its outer end so that the inner diameter of the connector tube can be made substantially the same as the primary inner diameter of the tube bundle tubing that adjoins the enlarged end.

BRIEF DESCRIPTION OF THE DRAWINGS

FIG. 2 is a perspective, partially schematic view of a condenser tube bundle.

FIG. 3 is an enlarged cross-sectional view of a portion of the tube bundle illustrating the manner in which the tube bundle is supported.

DESCRIPTION OF THE PREFERRED EMBODIMENT

Figure 1:
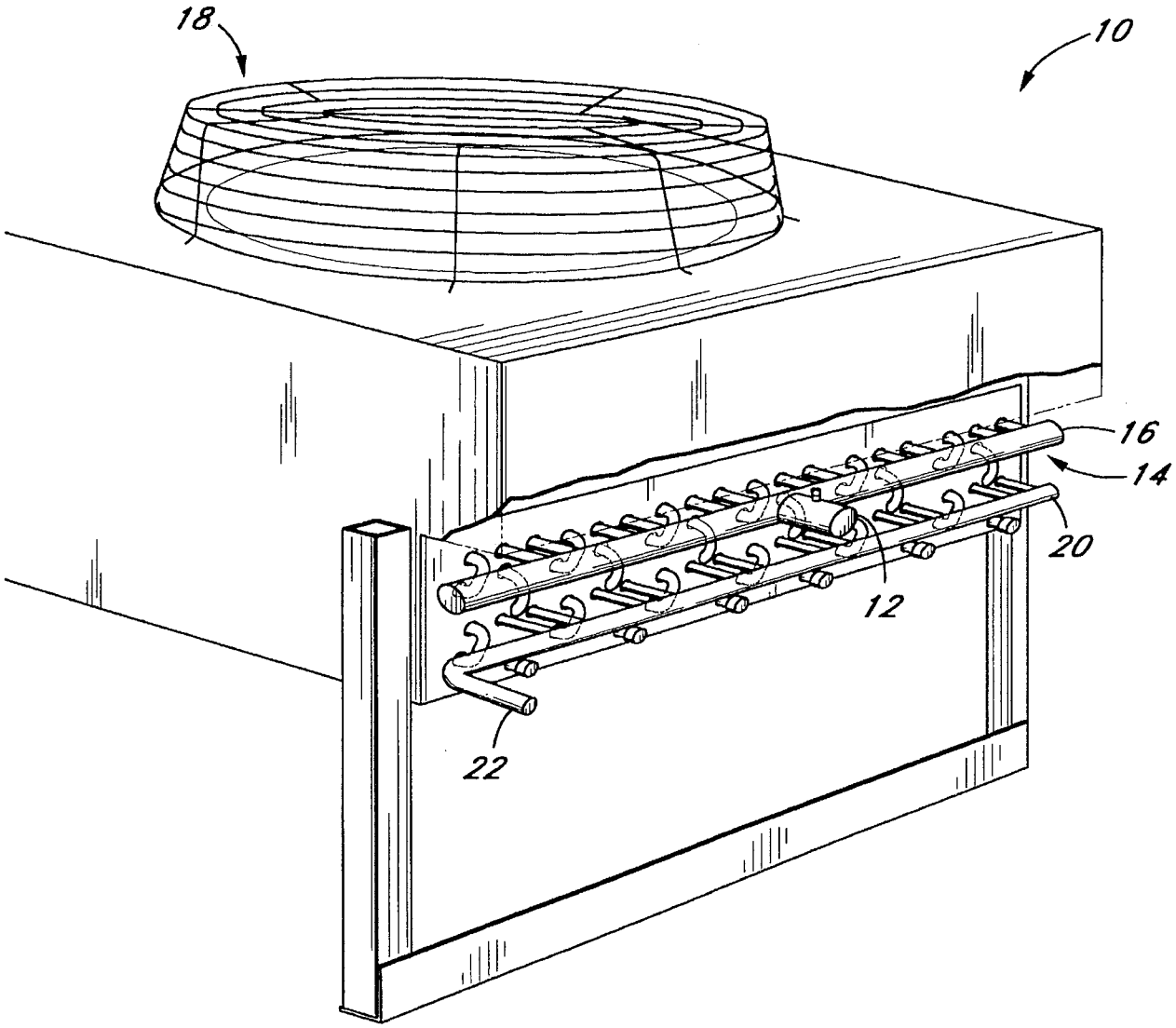
FIG. 1 is a perspective view of an air-cooled condenser system.

Referring to FIG. 1, there is illustrated an air-cooled refrigeration condenser 10 of the type that might be typically mounted on the roof of a building wherein gaseous refrigerant is conducted through a conduit 12 into bundles of heat exchanger tubes 14. FIG. 1 illustrates an air cooled condenser 10, but the heat exchange tube bundle could be used in an evaporator or in other heat exchange structures in addition to a condenser. The incoming fluid is conducted to an inlet header 16 and from there is dispersed into one or more tube circuits. Cooling air is drawn through the tube bundle 14 by a fan 18. The condensed refrigerant is conducted to a return header 20, which in turn conducts the fluid through a conduit 22 connected to the refrigeration system.

FIGS. 2 and 3 illustrate some of the details of a tube bundle 14, wherein a plurality of substantially parallel heat exchanger tubes 24 are connected in pairs at their ends by return bends 26 to provide a circuit for refrigerant. Preferably, the fluid-carrying tubes 24 are made from thin-walled copper but of course other materials having desirable strength and heat transfer properties may be employed.

The supporting structure for the tube bundle 14 includes two parallel end plates 28, one or more center plates 30, and nonfluid carrying support members 32. The end support plates 28 as well as the center support plates 30 include openings 34 through which the fluid-carrying tubes 24 extend. As seen from FIG. 3, these openings 34 have a larger diameter than the exterior of the tubes 24 so that the tubes 24 are not supported directly by the support plates 28, 30. The nonfluid-carrying support members 32 also extend through openings 36 in the support plates 28, 30, but these members 32 are attached to the support plates 28, 30, again as shown in FIG. 3.

The support members 32 and the fluid-carrying tubes 24 extend through a plurality of thin metal plate-like fins 38 that extend in spaced, parallel relation. Typically, the fins 38 extend from a location close to one end support plate 8 to the other end support plate 28. Two of such fins 38 are illustrated in FIG. 3. The fins 38 are fixed to the support members 32, as well as the fluid-carrying tubes 24, with the result that the fluid-carrying tubes 24 are supported by the fins 38. This enables the fluid-carrying tubes 24 to move with respect to the support plates 28, 30 without having any frictional contact which could result in leaks in the tubes 24.

In accordance with the invention, the support members 32 are formed by thin-walled tubes 40, preferably made of copper, and rods 42, preferably made of steel, extending through the support tubes 40. Of course other materials of sufficient strength may be employed. An end cap 44 is shown positioned on the end of the support member 32 to shield the steel rod 42 from the environment, and thus minimize the risk of corrosion of the steel.

The fluid-carrying tubes 24 are typically fixed to the fins 38 in a well known manner by extending the tubes 24 through aligned holes 46 in a large number of fins 38. A tube expander (not shown) is then moved through the fluid-carrying tubes 24 to enlarge the diameter of the fluid-carrying tubes 24 sufficiently to force them into tight engagement with the holes 46 through the fins 38. Thus, a frictional fit is obtained with the fins 38 without the need for soldering or welding.

An advantage of the support arrangement of the invention is that this same technique of expanding thin-walled copper tubes can be used for the support members 32. That is, the support members 32 are formed by initially using a thin-walled copper tube 40 and expanding its diameter in the same fashion and utilizing the same readily available apparatus to expand the support tubes 24 into tight engagement with the fins 38. After this is completed, the support rod 42 is inserted into the support tube 40.

A bundle of tubes 14 could of course be supported by simply using copper support tubes 40. However, if thin-walled copper tubing is used that can be expanded utilizing the same equipment that expands the fluid-carrying tubes 24, it is necessary to use a considerable number of tubes 40 in order to have adequate supporting strength. Another alternative is to use thicker walled copper tubes or larger diameter copper tubes. This in turn requires the use of different equipment than that which is available for expanding the conventional fluid-carrying tubes 24. Alternatively, solid support rods 42 would provide greater strength, but that in turn requires a different technique for connecting the fins 38 to the support rods 42. Thus, the advantage of the arrangement illustrated is that thin-walled copper tubing can be employed for the support tubes 40, but yet the number of support members 32 required is minimized in that the thin-walled support tubing is reinforced by the solid rods 42, preferably made of steel.

Providing some dimensions and clearances or interferences may make the invention more clearly understood. The copper support tube 40 might have an external diameter of ½ inch. The hole 36 through the support plates 28, 30 would have a similar diameter with essentially zero clearance so that there would be a tight fit between the exterior of the thin-walled copper tube 40 and the support plates 28, 30. The thin-walled copper tube 40 is then expanded by about 0.005 inch to thus create an interference fit with the support plates 28, 30. The steel rod 42, which is then driven into the tube 40, has about 0.005 inch tolerance with the tube internal diameter, and thus creates an interference fit with the copper support tube 40.

It is anticipated that with such construction the number of support members 32 required would be approximately 8–10 percent of the number of refrigerant-carrying tubes 24. The tube bundles 14 vary in size, as does the length of the tubes 24. A typical tube bundle 14, however, might have 60–150 ½-inch tubes or 72–180 ⅜-inch tubes. These tubes 24 might be typically 7 feet long and be supported by two end plates 28 and one center support plate 30.

Figure 4:
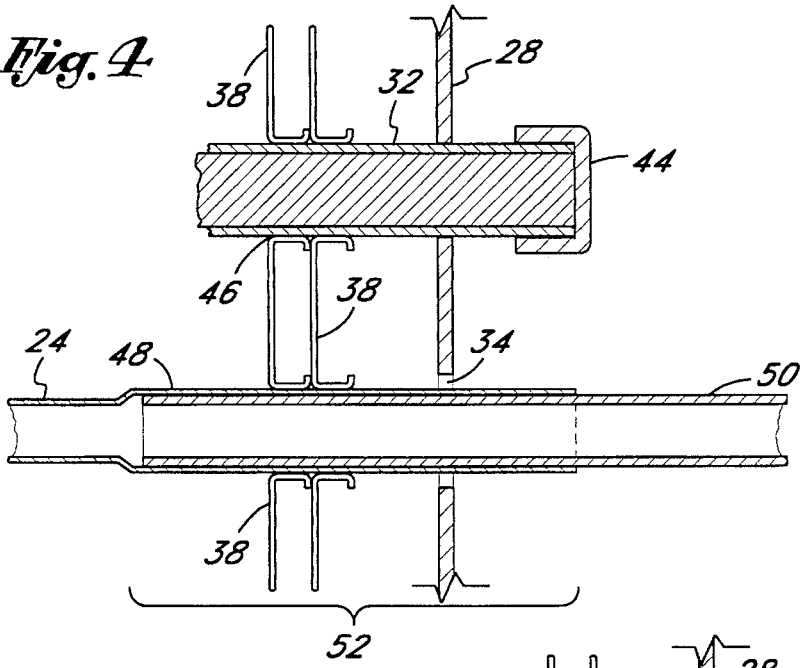
FIG. 4 is an enlarged cross-sectional view of a portion of the tube bundle illustrating the manner in which the tube bundle is supported and illustrating the manner in which a header connector tube is supported by the tube bundle.

As mentioned above, the fluid-carrying tubes 24 must be connected to inlet and outlet headers 16, 20, which in turn are connected to inlet and outlet piping 12, 22 that connect the heat exchanger to the rest of the refrigeration circuit. FIG. 4 illustrates a preferred arrangement for accomplishing that connection. As shown, the end 48 of a fluid-carrying tube 24 that extends through some of the end fins 38 and through the hole 34 in the support plate 28 has been slightly enlarged. A connector tube 50 that extends from the header 16 or 20 extends into the enlarged tube 48 in the tube bundle 14 sufficiently far that the connector tube 50 passes through the holes 46 in several of the fins 38. This overlapping connection 52 strengthens the joint, and the fact that the overlapping connection 52 extends through some of the fins 38 further strengthens the structure such that the risk of leakage in that area is greatly minimized. By enlarging the end 48 of the fluid-carrying tube 24 and having the connector tube 50 of similar structure as the tube 24 in the tube bundle 14, the internal diameter of the connector 50 and the adjacent portion of the tube 24 in the tube bundle 14 is approximately the same, so that discontinuities in the fluid flow are minimized.

Figure 5:
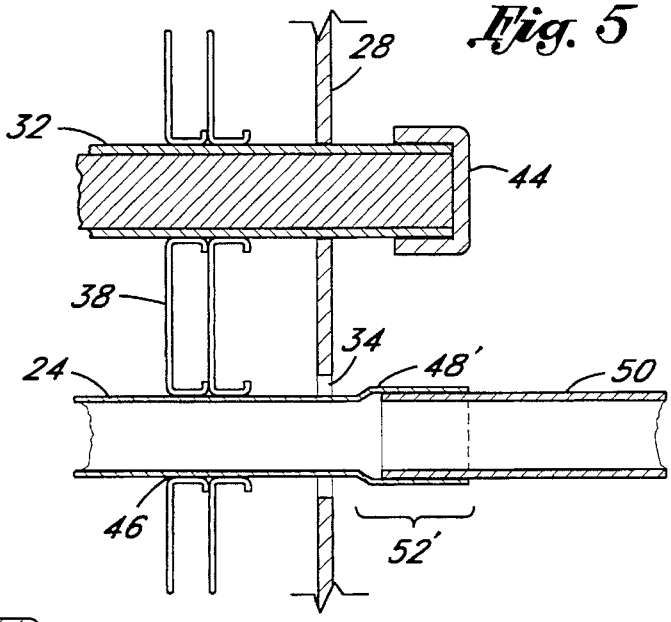
FIGS. 5 and 6 are views similar to FIG. 4 but illustrate additional, but less satisfactory methods of supporting the header.
Figure 6:
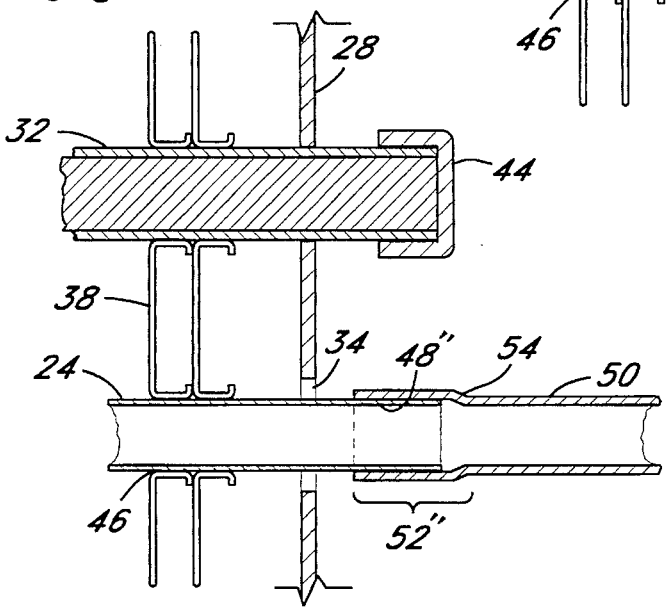

FIGS. 5 and 6 illustrate alternate constructions for the connections between the tube bundle and the header connector tubes, and that the support members 32 are useful with any of the FIG. 4–6 arrangements. The FIG. 5 construction is similar to FIG. 4, except that the connector tube 50 does not extend far enough into the enlarged tube end 48' to intersect the end fins 38 of the tube bundle 14. Thus, the overlapping connection 52' is much reduced from the preferred approach and does not serve to strengthen the joint and minimize leakage.

In FIG. 6, the connector tube 50 has been enlarged at one end 54 so that it fits over the unenlarged end 48" of the tube 24 from the tube bundle 14. This, as in FIGS. 4 and 5, creates an internal diameter with minimal discontinuity at the joint. However, as in the construction of FIG. 5, the overlapping connection 52" is much reduced from the preferred connection 52 of FIG. 4.

The embodiments illustrated and described above are provided merely to indicate a few possible constructions of the finned heat exchanger support system of the present invention. Other changes and modifications may be made from the embodiments presented herein by those skilled in the art without departure from the spirit and scope of the invention, as defined by the appended claims.

I claim:

1. A heat exchanger, comprising:

a plurality of spaced support plates;

a plurality of spaced elongated support members extending between and fixed to said plates, said elongated support members including support tubes joined to said support plates and support rods extending through said support plates, an exterior of said support rods tightly engaging an interior of said support tubes;

a bundle of tubes arranged in generally spaced parallel relation with said tubes extending through holes in said support plates;

a plurality of heat transfer fins secured to the tubes and to the support members whereby said tubes are supported by said fins, said holes in said plates being larger than said tubes so that said tubes move freely in said holes in response to thermal expansion and contraction and in response to vibration;

a tubular header at one end of said tubular bundle to be connected to a fluid inlet line; and a pair of spaced tubular connectors joining said header to ends of two of said tubes, each of said connectors having an end portion which is telescopically received within an end of a respective one of said tubes, with said connector ends extending through portions of said ends of said tubes that pass through one of said plates and at least one of said fins to provide a firm support for said header.

2. The heat exchanger of claim 1, wherein said support tubes are made of thin-wall copper, and said support rods are made of steel.

3. The heat exchanger of claim 1, wherein said ends of said tubes connected to said tubular connectors have been enlarged so that the interior diameter of said connectors is about equal to the interior diameter of the tubular portions adjacent said enlarged tube ends.

4. A method of making a heat exchanger, comprising:

positioning a bundle of spaced parallel heat exchange tubes through holes in a plurality of plate-like, spaced fins;

providing one or more support tubes each having a support rod tightly engaged therein;

positioning said one or more support tubes through holes in said fins;

positioning ends of said support tubes through holes in a pair of spaced support plates;

inserting a tool into each of said support tubes to enlarge the exterior diameter of said support tubes into tight engagement with said fins and with said support plates; and expanding the diameter of said heat exchange tubes into tight engagement with said fins, the holes in said support plates through which the ends of said heat exchange tubes extend being sufficiently large such that the expanded heat exchange tubes do not engage said support plates, but instead can move freely with respect to said support plates.

5. A method of making a heat exchanger, comprising:

positioning a plurality of fluid-carrying tubes in spaced, generally parallel relation;

securing said tubes to a plurality of spaced parallel fins extending generally in perpendicular relation to said tubes;

securing one or more support tubes to said fins, a support rod secured in each of said support tubes;

extending the ends of said tubes through holes in a pair of spaced support plates;

securing said support tubes to said plates;

positioning a pair of spaced tubular connectors of a tubular header adjacent the ends of a pair of said tubes; and connecting said header to said ends of said pair of tubes with end portions of said pair of connectors extending into said ends of said pair of tubes sufficiently far to intersect one of said support plates and one or more of said fins.

6. The method of claim 5, including enlarging said ends of said pair of tubes so that when said tubular connectors are joined to said pair of tubes, the interior diameters of said connectors are approximately the same as the interior diameters of the portions of said pair of tubes adjacent said ends of said pair of tubes.

7. A heat exchanger, comprising:

a plurality of spaced support plates;

a plurality of spaced elongated support members extending between and fixed to said plates, said elongated support members including support tubes joined to said support plates and support rods extending through said support plates, said support rods tightly engaged in said support tubes;

a bundle of tubes arranged in generally spaced parallel relation with said tubes extending through holes in said support plates; and a plurality of heat transfer fins secured to the tubes and to the support members whereby said tubes are supported by said fins, said holes in said plates being larger than said tubes so that said tubes move freely in said holes in response to thermal expansion and contraction and in response to vibration.

8. The heat exchanger of claim 7, further comprising a tubular header at one end of said tubular bundle to be connected to a fluid inlet line and a pair of spaced tubular connectors joining said header to ends of two of said tubes.

9. The heat exchanger of claim 8, wherein each of said connectors has an end portion which is telescopically received within an end of a respective one of said tubes, said connector ends extending through portions of said ends of said tubes without passing through said plates in a direction toward said fins.

10. The heat exchanger of claim 8, wherein each of said connectors has an end portion which is enlarged to telescopically receive an end of a respective one of said tubes such that the interior diameter of said tubes is about equal to the interior diameter of the connector portions adjacent said enlarged connector ends.

* * * * *